US005275294A

United States Patent [19]

Krenzler

[11] Patent Number: 5,275,294

[45] Date of Patent: Jan. 4, 1994

[54] ROTATING GOLD PAN FOR SEPARATING GOLD PARTICLES FROM ORE

[76] Inventor: Leo M. Krenzler, 1142 Industry Dr., Seattle, Wash. 98188

[21] Appl. No.: 990,118

[22] Filed: Dec. 14, 1992

Related U.S. Application Data

[63] Continuation-in-part of Ser. No. 817,134, Jan. 6, 1992.

[51] Int. Cl.[5] ..... B03B 5/02

[52] U.S. Cl. ..... 209/434; 209/444; 209/451; 209/508

[58] Field of Search ..... 209/413, 414, 434, 444, 209/451, 452, 484, 505, 508

[56] References Cited

U.S. PATENT DOCUMENTS

| | | | |
|---|---|---|---|
| 267,049 | 11/1882 | Wilson | 209/414 |
| 840,354 | 1/1907 | Lyle . | |
| 1,081,421 | 12/1913 | Arnold | 209/434 X |
| 1,985,514 | 12/1934 | McCleery | 209/444 X |
| 3,855,119 | 12/1974 | Stephenson | 209/447 |
| 4,008,152 | 2/1977 | Kleven | 209/444 |
| 4,267,036 | 5/1981 | Kleven | 209/444 |
| 4,389,308 | 6/1983 | Cleland | 209/444 |
| 4,406,783 | 9/1983 | Cleland | 209/444 |
| 4,476,014 | 10/1984 | Cleland | 209/434 |
| 4,517,079 | 5/1985 | Cleland | 209/444 X |
| 4,522,711 | 6/1985 | Cleland | 209/444 X |
| 4,561,973 | 12/1985 | Cleland | 209/434 |
| 4,642,180 | 2/1987 | Kaufman | 209/414 X |

FOREIGN PATENT DOCUMENTS

| | | | |
|---|---|---|---|
| 371153 | 3/1923 | Fed. Rep. of Germany | 209/414 |

*Primary Examiner*—Andres Kashnikow
*Assistant Examiner*—J. A. Kaufman
*Attorney, Agent, or Firm*—Delbert J. Barnard

[57] ABSTRACT

A separator pan (10) is set into a rearwardly leaning position (FIG. 4 ). A lower portion of the pan sidewall (28) slopes downwardly as it extends outwardly from the pan bottom (12). A spiral rib (32), inside of the pan (10) slopes upwardly as it extends axially outwardly from the interior of the pan (10). Pan (10) is rotated in a direction causing the spiral rib (32) to coil inwardly. Large particles of gold ore, introduced into the pan (10), gravitate out from the pan, owing to the sloping nature of the lower portion of pan sidewall (28). Smaller particles, including small particles of gold, are trapped between spiral rib (32) and sidewall (28) and bottom wall (12) of pan (10). As the pan (10) rotates, these small particles are moved inwardly and into a hub cup (14).

21 Claims, 8 Drawing Sheets

Fig. 3
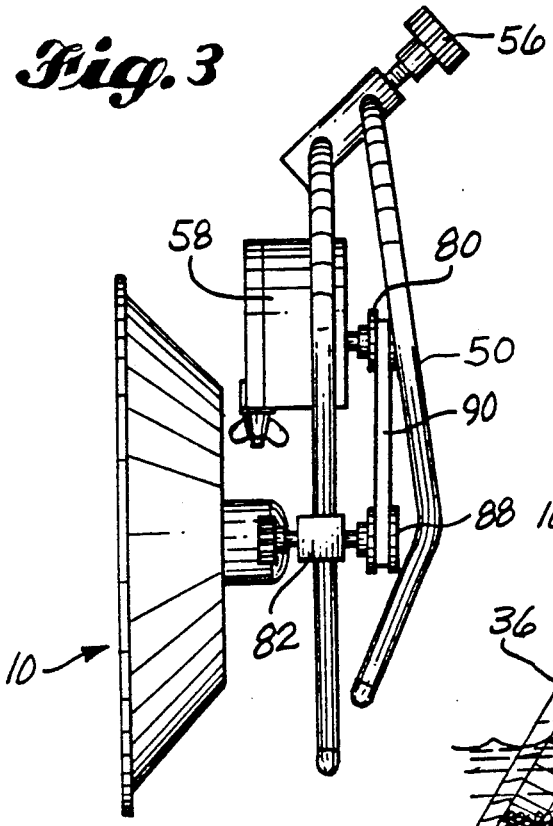
Fig. 4
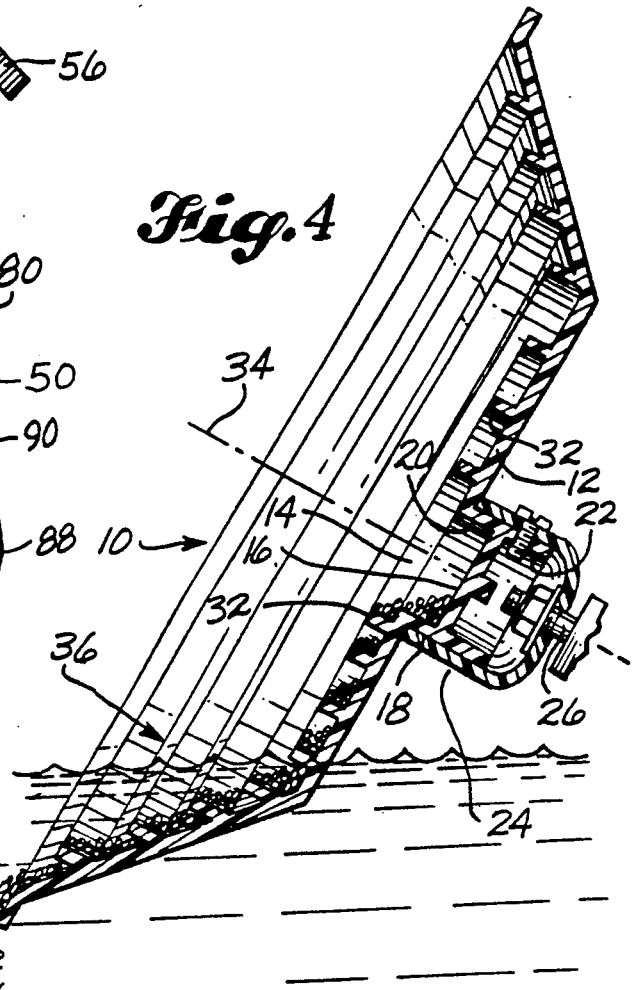
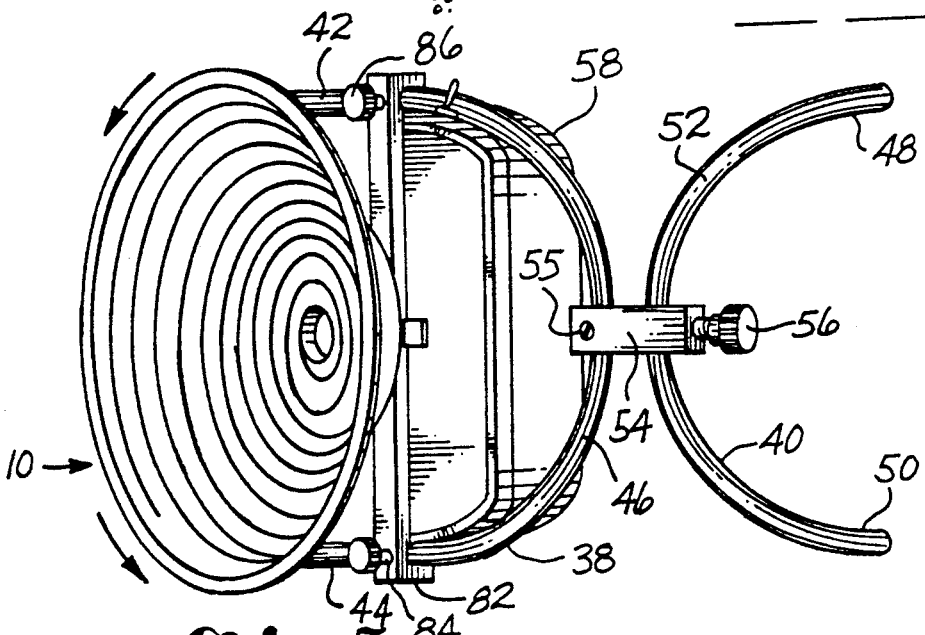
Fig. 5

Fig. 8
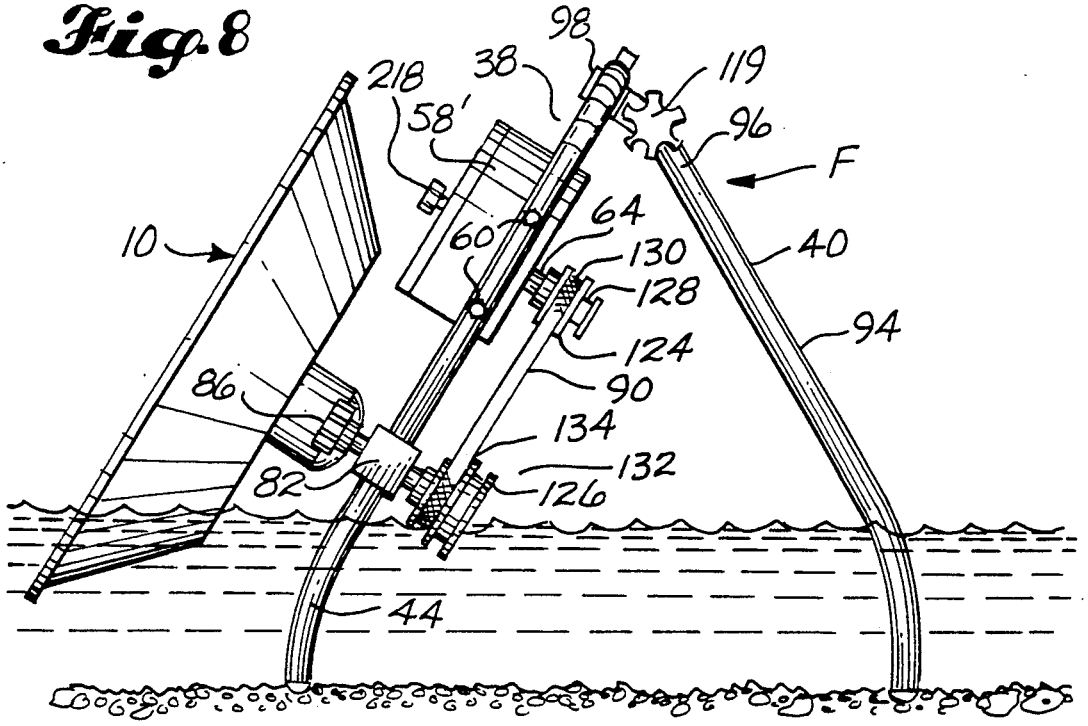
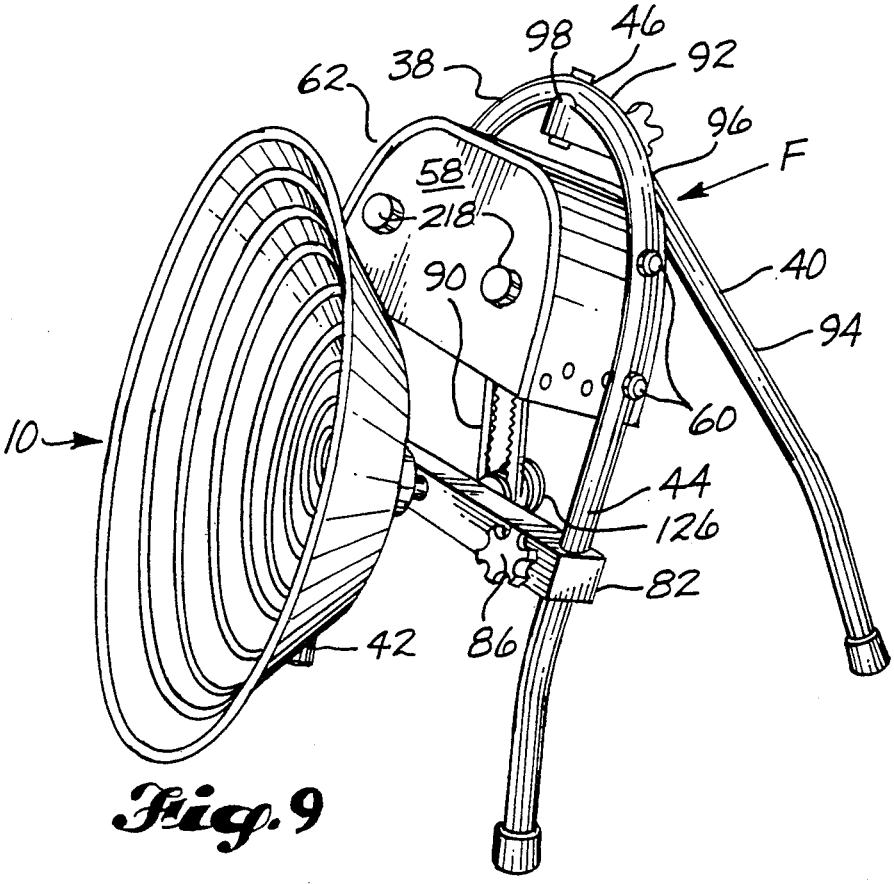
Fig. 9

Fig. 14
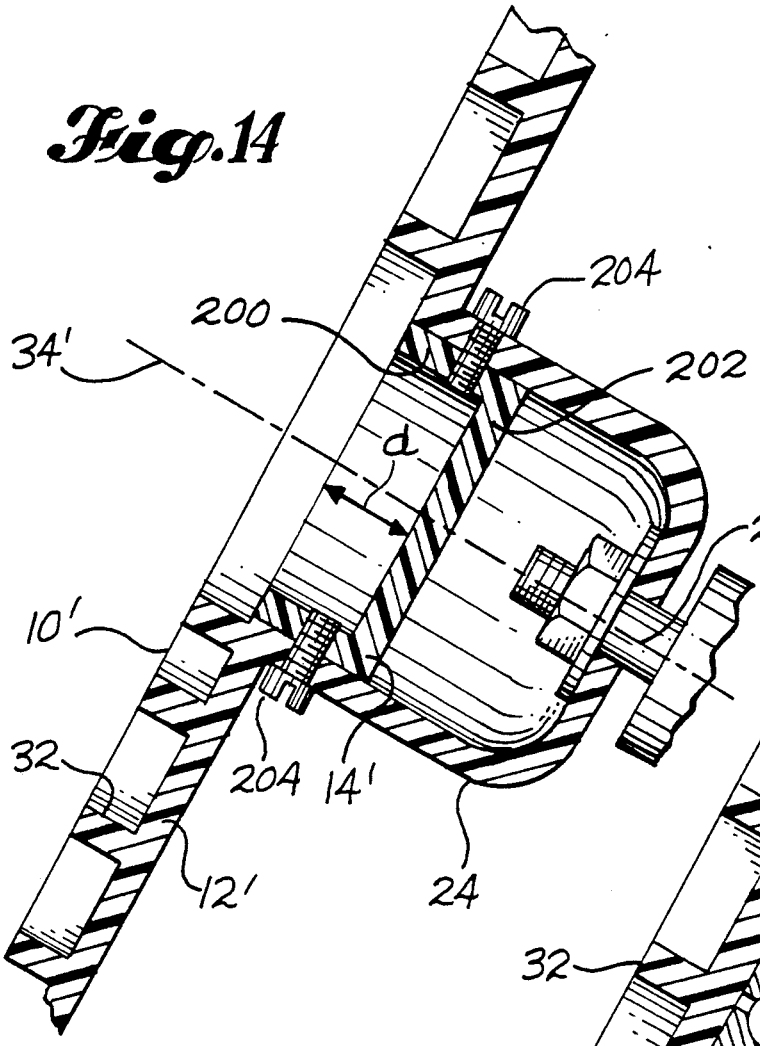
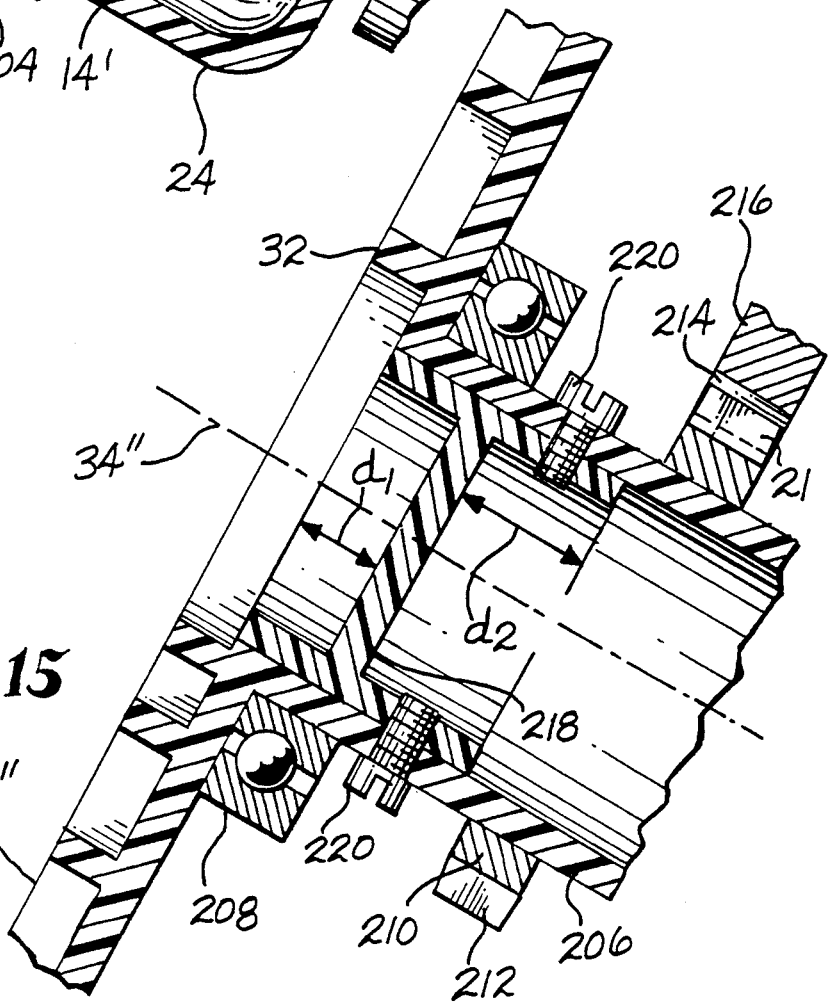
Fig. 15

ROTATING GOLD PAN FOR SEPARATING GOLD PARTICLES FROM ORE

RELATED APPLICATIONS

This application is a continuation-in-part of U.S. patent application Ser. No. 07/817,134, filed Jan. 6, 1992, entitled "Rotating Gold Pan For Separating Gold Particles From Ore" still pending.

TECHNICAL FIELD

This invention relates to the separation of gold particles from gold ore and placer materials. More particularly, it relates to the provision of a rotating gold pan which includes a spiral rib which moves gold particles into a hub cup while larger particles of gold ore gravitate out from the rotating gold pan.

BACKGROUND ART

Hand-held and hand manipulated gold pans have been used for many years for separating small gold particles from non-gold materials, and in particular from gold ore and placer found in stream or river beds. This type of gold mining is quite difficult to learn. Also, gold separating by the hand panning method is difficult and tedious even to an experienced gold panner. A principal object of this invention is to provide a frame supported rotating gold pan which includes a spiral rib in its interior leading to a hub cup. Gold ore is introduced into the pan as the pan is rotated. Large pieces of non-gold placer gravitate out from the pan. Small particles, including gold particles, are moved by a spiral rib, to the center of the pan, into the hub cup.

DISCLOSURE OF THE INVENTION

The separator of the present invention is basically characterized by a rotatable gold pan which includes a bottom, a frusto-conical sidewall, a hub cup at the center of the bottom and a spiral rib which starts from the hub cup and spirals outwardly, first on the bottom of the pan and then on the sidewall of the pan. The pan is mounted onto a frame for rotation about a centerline axis. The pan leans backwards from vertical. The lower portion of the pan sidewall slopes downwardly and outwardly from the bottom of the pan. The spiral rib slopes upwardly and outwardly from the inner surface of the pan. In use, the pan is rotated in a direction causing particles on the spiral rib to move inwardly along the spiral rib towards the hub cup. In use, gold ore is introduced into the lower portion of the pan while the pan is being rotated. The heavy particles of the non-gold material gravitate out from the pan and small gold particles are caught by the rib and are moved by the rib inwardly into the hub cup.

In one form of the invention, the separator is first used dry, to separate a dry ore or placer material. Then the collected ore concentrate is separated again in water.

In preferred form, the frame comprises a first frame part and a second frame part. The first frame part includes first and second legs and a top portion interconnecting the first and second legs. The second frame part includes third and fourth legs and a second top part interconnecting the third and fourth legs. A connector interconnects the first and second top parts. The connector is operable to allow movement of the third and fourth legs toward the first and second legs, to collapse the frame for stowage. The connector is also operable for movement of the third and fourth legs away from the first and second legs, to establish an in use position of the two frame members, in which the two frame members diverge apart from the connector and the lower ends of the legs are spaced apart and provide a four point support for the frame.

Also in preferred form, the separator includes a housing connected to the first frame member. The housing contains a drive motor and may also include a battery. The first frame member also includes a lower transverse frame member on which the pan is mounted for rotation. The motor is attached to a first pulley and the pan is attached to a second pulley. A drive belt interconnects the two pulleys.

Preferably, the battery which operates the drive motor is a rechargeable battery. It may be recharged by a source of 110 volt alternating current. Or, it may be charged by a solar powered electrical generator, a portable generator, or any other suitable source of electrical power for recharging the battery. In some installations the battery may be eliminated and another source of electrical energy be directly coupled to the drive motor.

In another embodiment of the invention, the frame comprises a front part and a rear part. The front part has a first leg and a second leg and a top part interconnecting the first and second legs. The rear part has a single third leg with an upper end connected to the top part of the front part. The front part and rear part of the frame extend downwardly from their connection and diverge apart as they extend downwardly.

In another form of the invention, the transmission comprises a two stage first pulley attached to the drive motor, a two stage second pulley attached to the pan, and a drive belt interconnecting the two pulleys. The first pulley includes a small diameter stage and a large diameter stage. The second pulley includes a large diameter stage and a small diameter stage. The drive belt is positionable to interconnect the small diameter stage of the first pulley with the large diameter stage of the second pulley, or the large diameter stage of the first pulley with the small diameter stage of the second pulley. In preferred form, the transverse frame member is adjustably fixable to the first and second legs, allowing movement of the transverse frame member for purposes of providing a desired tension in the drive belt.

In another form of the invention, the front part of the frame is generally U-shaped and its top part is a bight interconnecting the first and second legs. The separator further includes a first connector member and a second connector member. The first connector member includes a body, a transverse bolt hole extending through the body, and a first side part which in use is generally vertically disposed. The first connector member is connected to the bight. The second connector member includes a body having a transverse bolt receiving opening and a second side part which in use is generally vertically disposed and is against the first side part. The second connector member is at the upper end of the third leg. A bolt is insertable through one of the transverse holes and threadably engageable with threads in the other transverse hole. The third leg can be pivotally moved into a desired position relative to the first and second legs and then the bolt can be tightened to draw the two side parts and the two connector members together, into tight engagement, for substantially holding the third leg in position relative to the first and second legs. In preferred form, the first and second side parts of the connector members include interfitting elements which lock the connector members against relative rotation when the bolt is tightened to draw the interfitting elements into engagement with each other.

The front part of the frame may be a single tubular member bent into a substantially U-shape. The first connector member may have a mounting end portion which includes a concave surface in contact with the tubular member at the bight. A fastener may secure the mounting end portion of the first connector member to the tubular member at the bight. The third leg of the frame may be a tubular member. The second connector member may include a mounting end portion which extends into the tubular member at the upper end of the third leg.

In another form of the invention, a separator is provided for separating gold particles from gold ore which comprises a pan mounting frame, a rotatable gold pan, a drive motor on the frame, and a two speed drive transmission interconnecting the drive motor and the pan. In use, the pan is rotated by the drive motor and transmission, such as a cone pulley system, at a selected speed and in a direction causing particles to move along a spiral rib in the pan and to be moved along the spiral rib to the hub cup. In a preferred form, the drive motor is positioned on the frame rearwardly of the pan and above the axis of the pan. The transmission comprises a first pulley attached to the drive motor, a second pulley attached to the pan, and a belt interconnecting the two pulleys. The first pulley may be a two stage pulley and include a small diameter stage and a large diameter stage. The second pulley may be a two stage pulley and may include a large diameter stage and a small diameter stage. The drive belt may be positionable to interconnect the small diameter stage of the first pulley with the large diameter stage of the second pulley or the large diameter stage of the first pulley with the small diameter stage of the second pulley. In another form, the drive motor and pan are positionable on the mounting frame to each counterbalance the other.

The present invention also includes a method of separating gold particles from gold ore. The method comprises providing a rotatable gold pan, providing a mounting frame for the pan, and mounting the pan on the mounting frame. The method further includes positioning the pan on the frame so that the pan leans rearwardly, providing a drive motor on the frame, and introducing gold ore into a lower portion of the pan while rotating the pan. In a preferred form, the method comprises providing a mounting frame for the pan which includes a front part having an upper part and a rear part having an upper part. The upper part of the rear part is adjustably connectable to the upper part of the front part. The method further includes mounting the pan on the front part and adjustably affixing the position of the rear part of the frame to the front part of the frame for determining the attitude of the pan.

In another preferred form, the method includes introducing dry gold ore into the lower portion of the pan while rotating the pan at a first speed. The relatively large particles are caused to gravitate radially of the pan and move across a rib and out from the pan and cause materials of higher specific gravity, such as small particles of gold, and some ore to fall on the rib and be held by the rib and be moved by the rib inwardly along the spiral path of the rib into the hub cup. The method further includes removing the collected gold particles and ore from the hub cup and mixing the gold particles and ore with water and introducing the mixture into the lower portion of the pan while rotating the pan at a selected second speed. The ore gravitates radially of the pan and move across the rib and out from the pan. The small gold particles fall on the rib and are held by the rib and moved by the rib inwardly along the spiral path of the rib and into the hub cup.

Other objects, features and advantages of the invention are hereinafter described as a part of the description of the best mode.

BRIEF DESCRIPTION OF THE DRAWINGS

Like reference numerals are used to designate like parts throughout the several views of the drawing, and:

FIG. 3 is a side elevational view of the separator with its frame folded into a second position for stowage;

FIG. 4 is an enlarged scale axial sectional view, taken through the pan, such view clearly showing that the lower sidewall portion of the pan slopes downwardly as it extends outwardly from the bottom of the pan, and further showing that the spiral rib slopes upwardly as it extends generally axially outwardly from the interior of the pan, such view showing small particles on the rib in the process of being moved by the rib to a hub cup at the center of the pan, and such view also showing larger particles gravitating out from the pan;

FIG. 5 is a top plan view of the separator when it is in its use position;

FIG. 8 is a view like FIGS. 2 and 7, but showing a different embodiment of the invention;

FIG. 9 is a view like FIG. 1, but showing the embodiment of the invention illustrated in FIG. 8;

FIG. 14 is a fragmentary enlarged scale, axial sectional view of a modified form of gold pan, characterized by a removable center cup;

FIG. 15 is a view like FIG. 14 of another form of the separator pan;

BEST MODE FOR CARRYING OUT THE INVENTION

Figure 1:
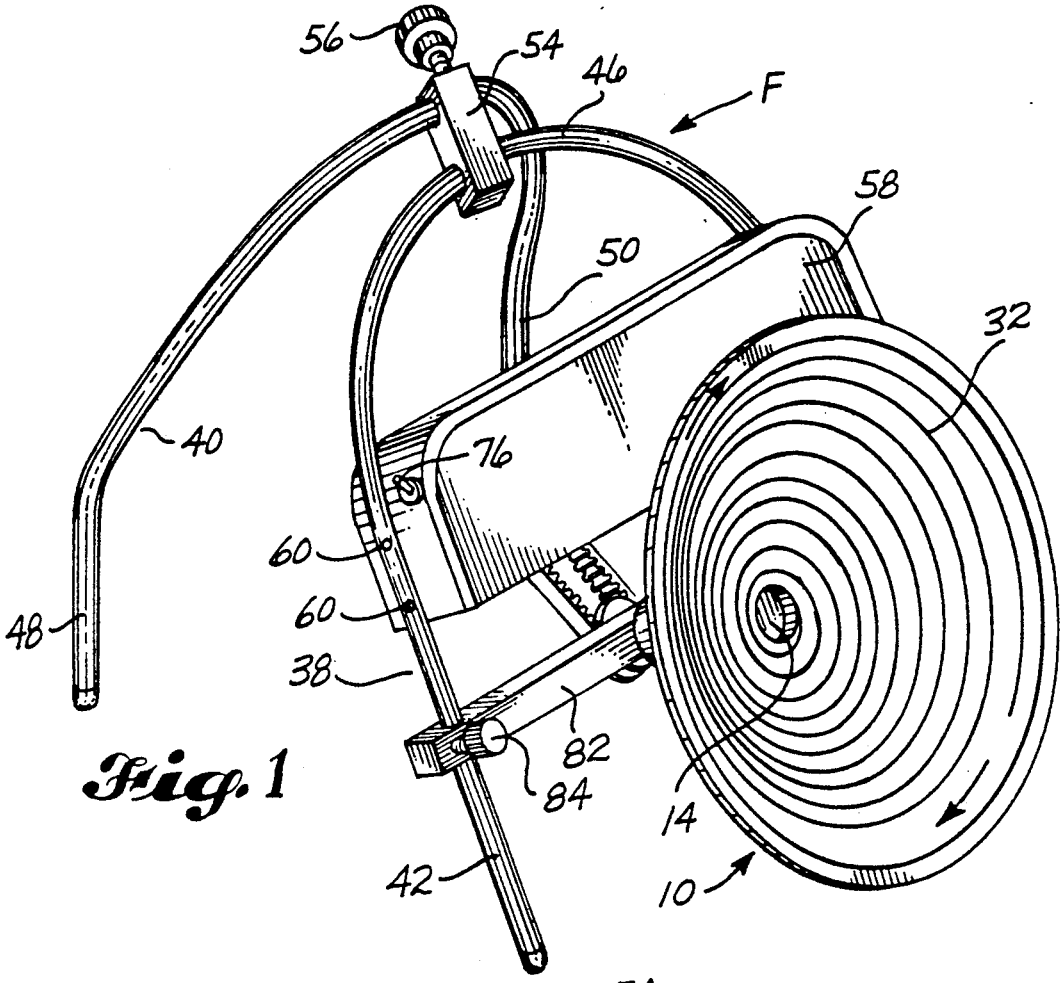
FIG. 1 is a pictorial view of an embodiment of the invention, in its use position, such view being taken from above and looking towards one side and the front of the separator.

The gold separator of the present invention is basically characterized by a separator pan 10. Pan 10 includes a bottom 12 which is substantially flat, except at its center where a hub cup 14 is located. Hub cup 14 may have a planer bottom 16 and a cylindrical sidewall 18. Referring to FIG. 4, cylindrical sidewall 18 is shown to include a forward portion 20 which interconnects bottom 16 with bottom wall 12. Cylindrical wall 18 also includes a rear portion 22 which extends axially rearwardly from bottom 16. As shown by FIG. 4, wall 18 fits snugly into a drive member 24. Drive member 24 is secured to a pan shaft 26 which will hereinafter be described.

Separator pan 10 includes a frusto-conical sidewall 28. Sidewall 28 has a small diameter end at which it is connected to bottom wall 12 and it increases in diameter as it extends axially outwardly from bottom wall 12 to a large diameter outer end. Pan 10 may also include a lip 30 at the outer end of sidewall 28. Lip 30 may extend substantially parallel to bottom wall 12. Inside the pan 10 there is a spiral rib 32. Rib 32 starts at the hub cup 14 and then travels a spiral path, first on the inner surface of bottom wall 12, and then on the inner surface of sidewall 28. Rib 32 terminates adjacent lip 30. In preferred form, the rib 32 is a thin wall which extends substantially parallel to the axis of rotation 34.

In use, separator pan 10 is oriented to lean backwards from vertical, with the lower portion of its sidewall 28 sloping downwardly as it extends outwardly from bottom wall 12, and with the rib 32 sloping upwardly as it extends outwardly from the interior of pan 10. This orientation is shown by FIG. 4. In use, the pan 10 is rotated while gold ore is introduced into the lower portion of the pan, generally along line 36. The downwardly sloping nature of the lower portion of sidewall 28 causes the larger particles of the ore to gravitate out from the pan 10. Also, water introduced into the pan washes out the light material. The heavy gold particles settle into the valley formed between rib 32 and the pan. The direction of rotation is such that smaller particles which fall onto the rib 32 are moved, as pan 10 rotates, along the rib into the hub cup 14. These small particles will include small gold particles which were in the gold ore.

Separator pan 10 may be constructed from any suitable material. In preferred form, it is constructed from a durable plastic material. In preferred form, the separator pan 10 is mounted onto a small frame which is movable between a use position (FIGS. 1, 2 and 5) and a folded position (FIG. 3), into which it is moved for transporting and stowage. In preferred form, the frame F comprises a first or front part 38 and a second or rear part 40. In one embodiment, as best shown by FIGS. and 5, the two frame parts 38, 40 have a substantially U-shape. Front frame part 38 comprises a pair of legs 42, 44 and an interconnecting top part or "bight" 46. In similar fashion, rear frame part 40 comprises a pair of legs 48, 50 and an interconnecting top part or "bight" 52.

Figure 2:
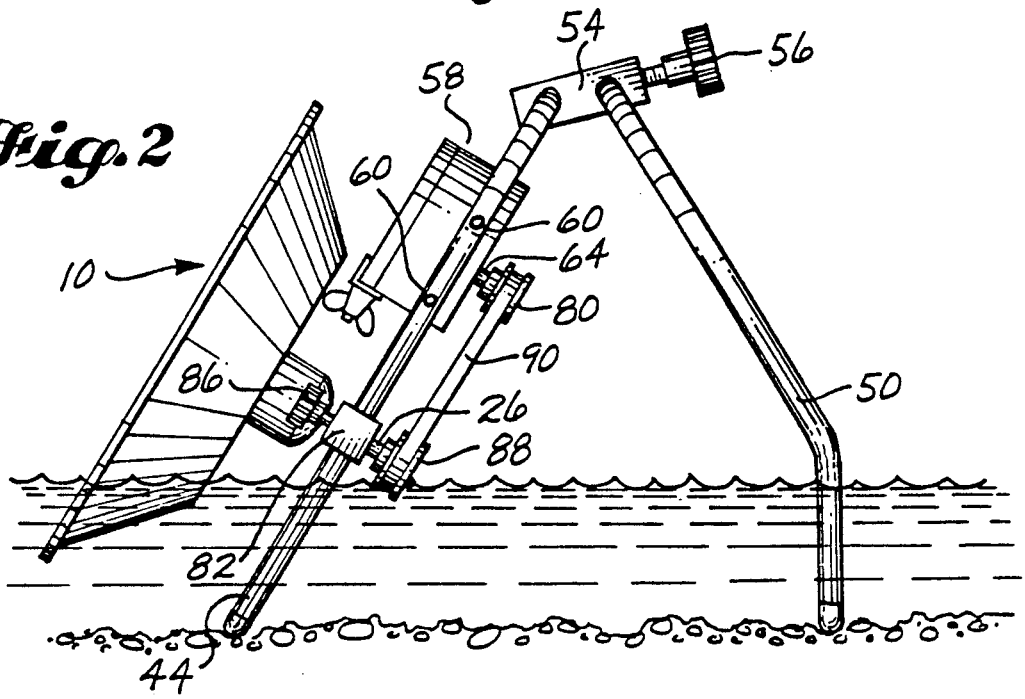
FIG. 2 is a side elevational view of the separator in its use position, shown within a shallow stream, with the separator pan disposed to lean backwards from vertical, and with the lower sidewall portion of the pan located in the water and disposed to slope downwardly as it extends outwardly from the bottom of the pan.
Figure 7:
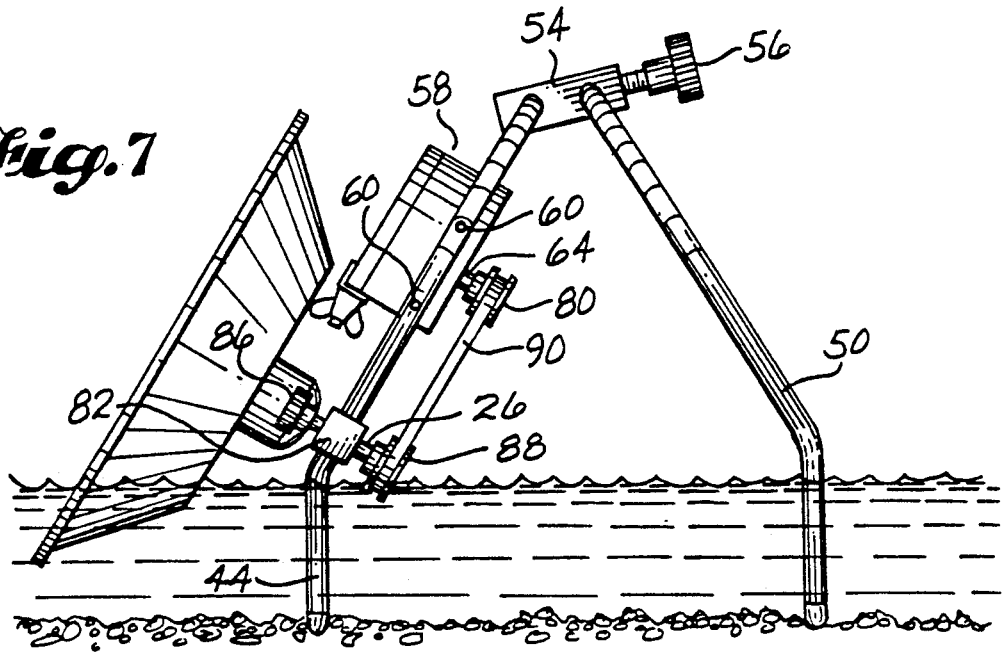
FIG. 7 is a view like FIG. 2, but showing a different configuration of the frame.

As shown by FIGS. 1 and 2, the lower portions of legs 48, 50 can be bent to extend at an angle to the upper portions of the legs 48, 50. The legs 42, 44 may be straight. In another embodiment (FIG. 7), the lower portions of legs 42, 44 may also be bent, so that all four legs 42, 44, 48, 50 have bent lower portions. All four legs 42, 44, 48, 50 are directed generally downwardly into the earth. This provides a very stable support for the pan 10. In still another embodiment, the legs 42, 44 may be bent and the legs 48, 50 may be straight. Also, it may be desirable to make all four legs 42, 44, 48, 50 straight. An advantage of bending the lower portions of legs 48, 50 is shown in FIG. 3. The bending of the legs 48, 50 makes the frame F more compact when it is in its folded condition.

The frame parts 38, 40 may be easily connected together by a connector block 54. Connector block 54 may be a solid block of plastic or other material in which two transverse openings are formed, one for top part 46 and the other for top part 52. A bolt 55 and a single set screw 56 may be provided for securing block 54 into position relative to frame part 52. Set screw 56 is loosened when it is desired to move the frame parts 38, 40 either together or apart. Then, it is tightened. Of course, any other suitable connector can be used for securing the two frame parts 38, 40 together. For example, a connector 54 may be used which is in the nature of a pair of housing parts, each with a pair of semi-cylindrical transverse grooves. One of these housing parts is placed below frame parts 46, 52, with the frame parts 46, 52 positioned within its semi-cylindrical grooves. Then, the second housing part is positioned down on top of the first housing part, with its semi-cylindrical grooves positioned over the frame parts 46, 52. Then, a screw is inserted to extend through the two frame parts. A wing nut or the like is positioned on the bolt and is used to tighten the bolt and Pull the two frame parts together, into a clamping relationship with the frame parts 46, 52.

Figure 6:
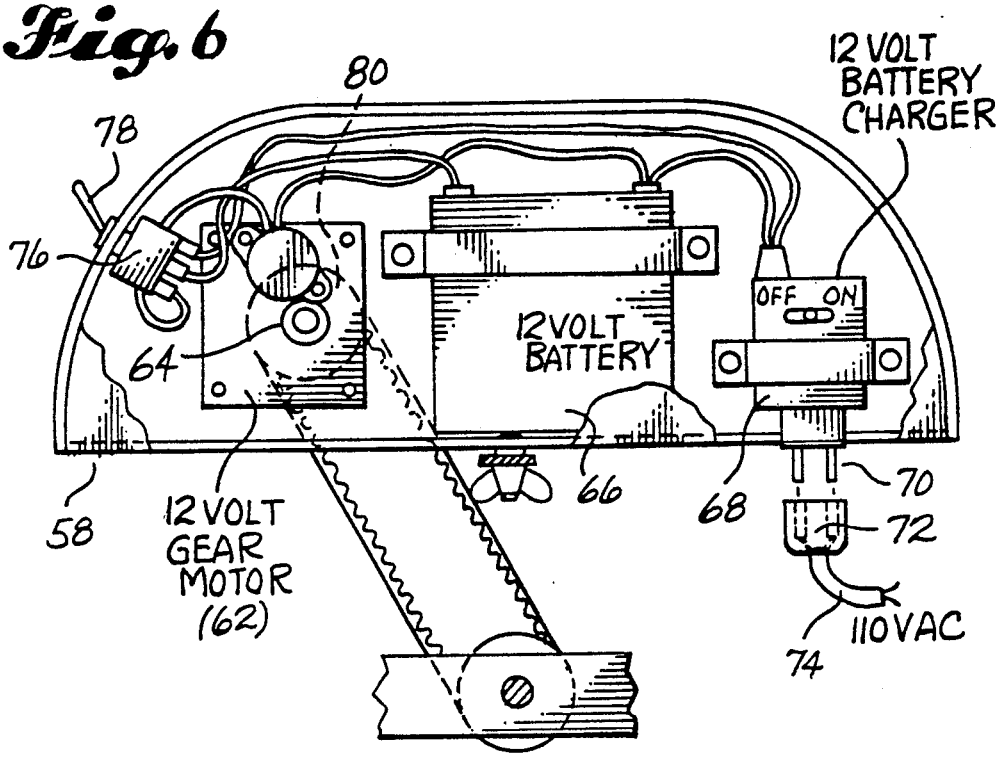
FIG. 6 is a fragmentary view showing components within a drive assembly housing, including a motor pulley, a pan pulley supported by a transverse frame member, and connected to the pan, and a drive belt interconnecting the two pulleys.

In preferred form, frame F is provided with a housing 58 which houses some of the drive components. As shown by FIGS. 1, 2 and 5, housing 58 extends between legs 42, 44. Housing 58 may be secured to legs 42, 44 by nut and bolt fasteners 60, or the like. As shown by FIG. 6, housing 58 includes a drive motor 62 which is preferably a twelve volt gear motor. It includes an output shaft 64 which extends outwardly through the back wall of the housing 58. Housing 58 also includes a twelve volt battery 66 which is preferably rechargeable. Housing 58 may also include a twelve volt battery charger 68 having a plug 70 which is connectable to a plug 72 on the end of a cord 74 leading to a source of 110 volt alternating current. Battery 66 may also be recharged by a solar energy powered recharger which may be mounted on housing 58 and used in addition to or in lieu of charger 68.

The battery 66, and the battery charger 68 (and/or the solar energy powered recharger) are a part of a control circuit which includes an off/on switch 76. Switch 76 includes a control arm 78 which is moved in a first direction to turn the switch 76 on and in an opposite direction to turn the switch 76 off. As shown by FIGS. 2 and 3, motor shaft 64 is connected to a first pulley 80. In preferred form, a transverse frame member 82 extends between frame legs 42, 44, below housing 58. Frame member 82 may be constructed from plastic and may include an opening for each leg 42, 44. A pair of set screws 84, 86 may be provided for securing frame member 82 to the frame members 42, 44. Frame member 82 carries a suitable bushing for drive shaft 26. The rear end of drive shaft 26 is connected to a second pulley 88. Pulleys 80, 88 are interconnected by a drive belt 90. The tension in drive belt 90 may be easily adjusted by the user merely loosening set screws 84, 86 and then moving frame member 82 downwardly until the proper tension is in the drive belt 90. Then, the set screws 84, 86 are tightened for the purpose of securing frame member 82 in a set position. This will maintain the established tension that was set in the drive belt 90.

The operation will now be described: The set screw 56 is loosened and the two frame parts 38, 40 are spread apart, into the position shown by FIGS. 1, 2 and 5. Then, set screw 56 is tightened. The frame F can then be set into a shallow portion of a stream, in the manner shown by FIG. 2. As best shown by FIGS. 2 and 4, the pan 10 is in what may be termed a rearwardly leaning position. That is, pan 10 leans rearwardly from vertical. Its axis of rotation 34 extends at an oblique angle which is perpendicular to the general plane of pan 10. As best shown by FIG. 4, when pan 10 is in this position it presents a lower sidewall portion which slopes downwardly as it extends forwardly from bottom 12. As previously described, spiral rib 32 slopes upwardly as it extends axially from the interior of pan 10. Gold ore can be hand or shovel fed into pan 10, along path 36, while pan 10 is rotated to cause spiral rib 32 to wind inwardly. Large particles of the ore will gravitate out from pan 10, because the lower portion of sidewall 28 slopes downwardly. Small particles will be caught between the spiral rib 32 and sidewall 28 and bottom wall 12. These particles will be moved by the rotation along the spiral path of rib 32 and will be deposited into the hub cup 14. Periodically the separator can be turned off and a pair of tweezers can be used for picking gold particles out from the hub cup 14.

In between use, the set screw 56 can be loosened and the rear frame part 40 moved forwardly into the position shown by FIG. 3. Then set screw 56 can be tightened to substantially hold the frame in the position shown by FIG. 3. As can be seen, the separator, when in its folded position, is relatively compact and can be easily transported. It can also be stowed in a relatively small amount of space.

In other embodiments a hand crank can be used for rotating the pan 10, in lieu of an electric motor. Also, the frame construction can vary considerably. The separator can be used to separate gold particles from dry ore. It is not necessary that it be used in water or with ore that has been subjected to water.

Another embodiment of the frame F is illustrated in FIGS. 8 and 9. The frame F has a front part 38 and a rear part 40. The front part 38 has a first leg 42 and a second leg 44. The first leg 42 and the second leg 44 are interconnected by a top part or bight 92. The front part 38 may be generally U-shaped. The rear part 40 has a third leg 94 having a top part 96 which is connected to the top part 92 of the front part 38. The three legs 42, 44, 94 of the frame F lends stability to the separator. In a preferred embodiment of the present invention, the drive motor 62 and the pan 10 are mounted on the frame F to counterbalance each other, to prevent the frame from tipping over.

The front part 38 and the rear part 40 of the frame F may be connected by a first connector member 98 connected to the front part 38 and a second connector member 100 connected to the rear part 40. Preferably, the first connector member 98 is connected to the bight 46. Also in preferred form, the rear part 40 has a second connector member 100 connected to the top part 92 of the rear part 40. The first connector member 98 and the second connector member 100 interconnect the front part 38 and the rear part 40 of the frame F.

Figure 10:
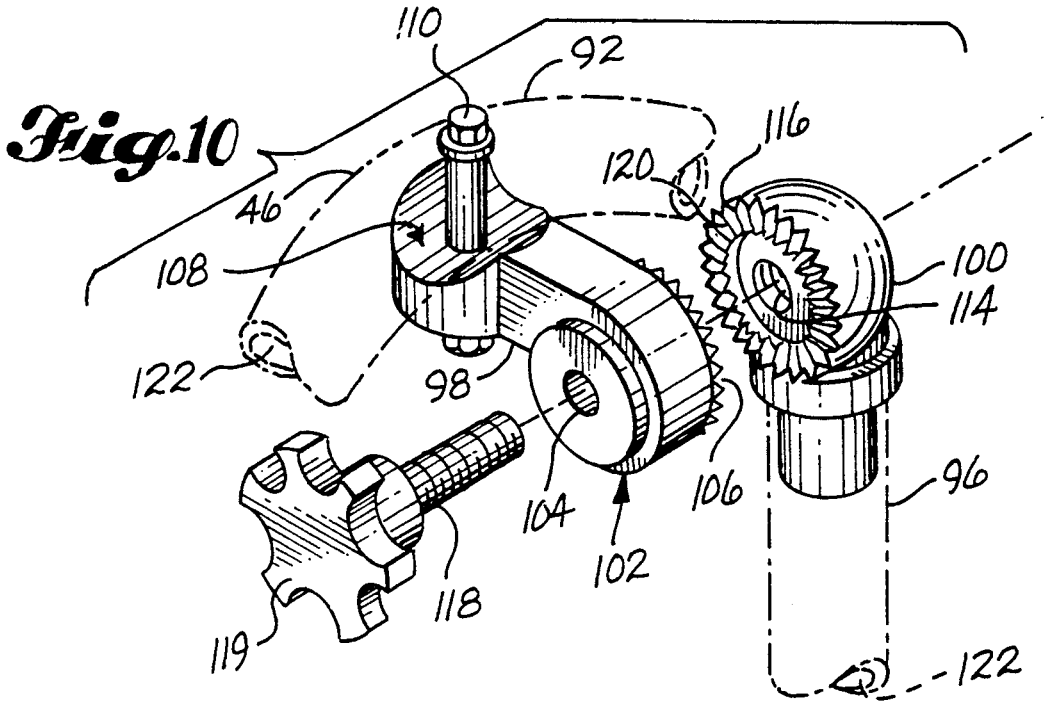
FIG. 10 is a fragmentary pictorial view of the first and second connector members for the frame configuration shown in FIGS. 8 and 9, with the bight of the front legs and the rear leg shown in phantom.

The first connector member 98 and the second connector member 100 may be of the type shown in FIG. 10. The first connector member 98 may include a body 102 with a transverse bolt hole 104 which extends through the body 102 and a first side part 106. The first connector member 98 may include a concave surface 108 which the bight 46 of the front part 38 contacts. The front part 38 may be connected to the first connector member 98 by a fastener 110 which extends through the bight 46 of the front part 38 and through the body of the first connector member 98. The fastener 110 may be a set screw having wing nuts at either end. The second connector member 100 may include a transverse bolt receiving opening 114 and a second side part 116. In use, a bolt 118 is inserted through the transverse bolt hole 104 in the first connector member 98 and through the transverse bolt receiving opening 114 in the second connector member 100 with the first side part 106 and the second side part 116 disposed against each other. The bolt 118 is tightened, such as by rotation of knob 119, to draw the two side parts 106, 116 of the two connector members 98, 100 together, and into tight engagement. The positioning of the front part 38 and the rear part 40 of the frame F may be adjusted by the placement of the first side part 106 relative to the second side part 116. The first side part 106 and second side part 116 may include interfitting elements 120, to allow for relative positioning of the frame F. The interfitting elements 120 may be teethed surfaces (e.g. radial ridges and grooves) capable of holding the side parts 106, 116 securely against each other.

Figure 11:
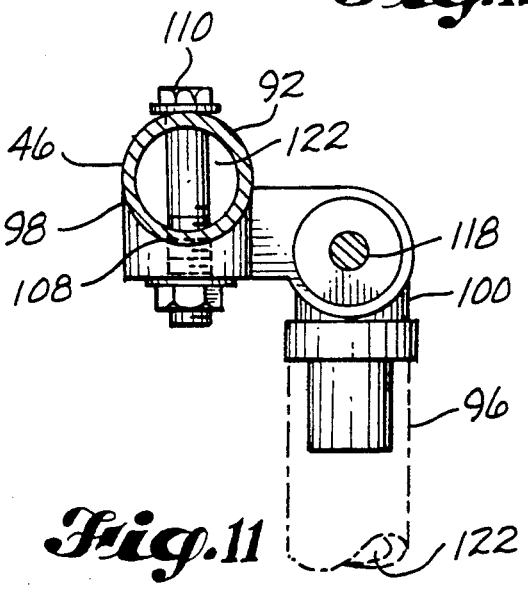
FIG. 11 is a sectional view of the first connector member and second connector member shown in FIG. 10, with the rear leg shown in phantom.

The front part 38 and the rear part 40 may each be a single tubular member having a hollow core 122, with the front part 38 bent into a substantially U-shape. The second connector member 100 may be fit inside of the hollow core 122 of the rear part 40, as illustrated in FIGS. 10 and 11.

In another embodiment of the invention, the motor shaft 64 of the drive motor 62 is connected to a two-stage first pulley 124. The two-stage first pulley 124 has a small diameter state 128 and a large diameter stage 130. The pan shaft 26 is connected to a two-stage second pulley 126. The two-stage second pulley 126 has a large diameter stage 132 and a small diameter stage 134. The first and second two-stage pulleys 124, 126 are interconnected by a drive belt 90, wherein the drive belt can be positioned to interconnect the small diameter stage 128 of the first pulley 124 with the large diameter stage 132 of the second pulley 126. The belt 90 may also interconnect the large diameter stage 130 of the first pulley with the small diameter stage 134 of the second pulley 126. Likewise, the belt may interconnect both small diameter stages 128, 134 or both large diameter stages 130, 132. The tension in the belt 90 may be adjusted by moving the transverse frame member 82. The two-stage pulleys 124, 126 provide different operating speeds for the system. It may be desirable to operate the system at different speeds to accomplish improved separation. For example, the separator may first be used to separate a dry gold ore at a first speed. The ore from the hub cup may then be mixed with water and the separator operated at a second speed for a wet separation of the ore.

Figure 12:
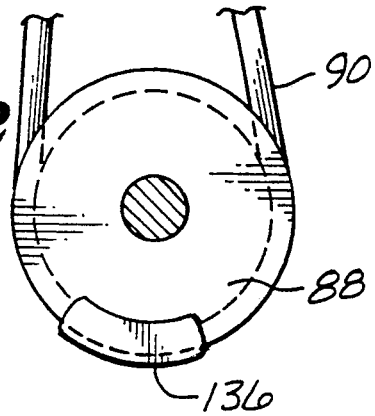
FIG. 12 is a sectional view of a pulley with a weight on the pulley.
Figure 13:
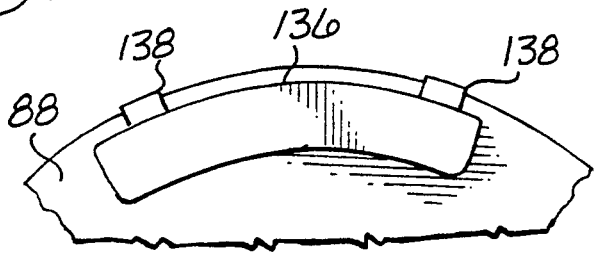
FIG. 13 is a fragmentary view of the weight shown in FIG. 12.

The pulleys in use on the present invention may also include a weight 136, as illustrated in FIGS. 12 and 13. The weight may include clips 138 which connect to the pulley. The weight 136 may be attached to one of the pulleys, such that the system is slightly off balance and the pan 10 will vibrate during separation. The vibration of the pan may be adjusted to achieve the desired level of separation.

FIG. 14 shows the center or hub region only of another embodiment of the separator pan 10'. In this embodiment, the drive member 24 is formed to be an integral part of the pan 10'. This embodiment includes a removable hub cup 14'. The hub cup 14' may have a cylindrical sidewall 200 and a bottom wall 202. The hub cup 14' may be secured in place by set screws 204. The embodiment of FIG. 14 may have one of the drives discussed above with respect to FIGS. 1–13. FIG. 15 discloses the center or hub region only of yet another embodiment of the separator pan 10'. In preferred form, the omitted portions of the pans 10' and 10'' are like the corresponding portions of pan 10 as shown in FIG. 4, for example.

The embodiment of FIG. 15 includes a tubular center shaft 206 that is supported by a suitable bearing or bushing, such as bearing 208. Bearing 208, or a plurality of such bearings, or a plurality of bushings, support the tubular shaft 206 for rotation about the center axis 34''. The bearing(s) or bushing(s) is suitably supported by a frame structure. The frame structure may be like one of the disclosed frame structures, or may be an entirely different type of frame structure. A drive gear 210 is secured to tubular shaft 206 in any suitable manner. The teeth 22 of gear 210 mesh with the teeth 214 of the drive input gear 216. The drive input gear 216 is driven in any suitable manner and may be driven at different speeds. Rotation of gear 216 imparts a rotation to gear 210 which in turn rotates the tubular shaft 206. This embodiment includes a center cup 218 which may be removably secured in place by set screws 220. Cup 218 may be double-ended with each end having a different depth d1, d2.

In accordance with the invention, the cup depth is preferably chosen to be shallow enough that the heavier particles entering into the cup will be able to push lighter materials forwardly out of the cup. It has been found that if a mixture of light and heavy materials enter the cup at a rate such that the cup does not have sufficient volume to hold all of the material, the heavier material will move to the bottom of the cup and in the process will push the lighter material forwardly and out from the cup. This is a desirable part of the separation process. Accordingly, it is important that the cup have a closed bottom and define a predetermined fixed volume.

In the embodiment shown by FIGS. 8 and 9, the housing 58' includes a cover that is held in place by set screws 218. The set screws 218 include a head or knob portion and a threaded shank which projects from the head or knob portion. Each threaded shank extends through an opening in the cover and screws into a threaded opening that is a part of the housing proper. The set screws 218 can be easily unscrewed and removed to allow the cover to be removed from the housing. The reverse is true. The cover can be set on the housing and the set screws installed one at a time and then rotated to secure or clamp the cover to the housing.

Figure 16:
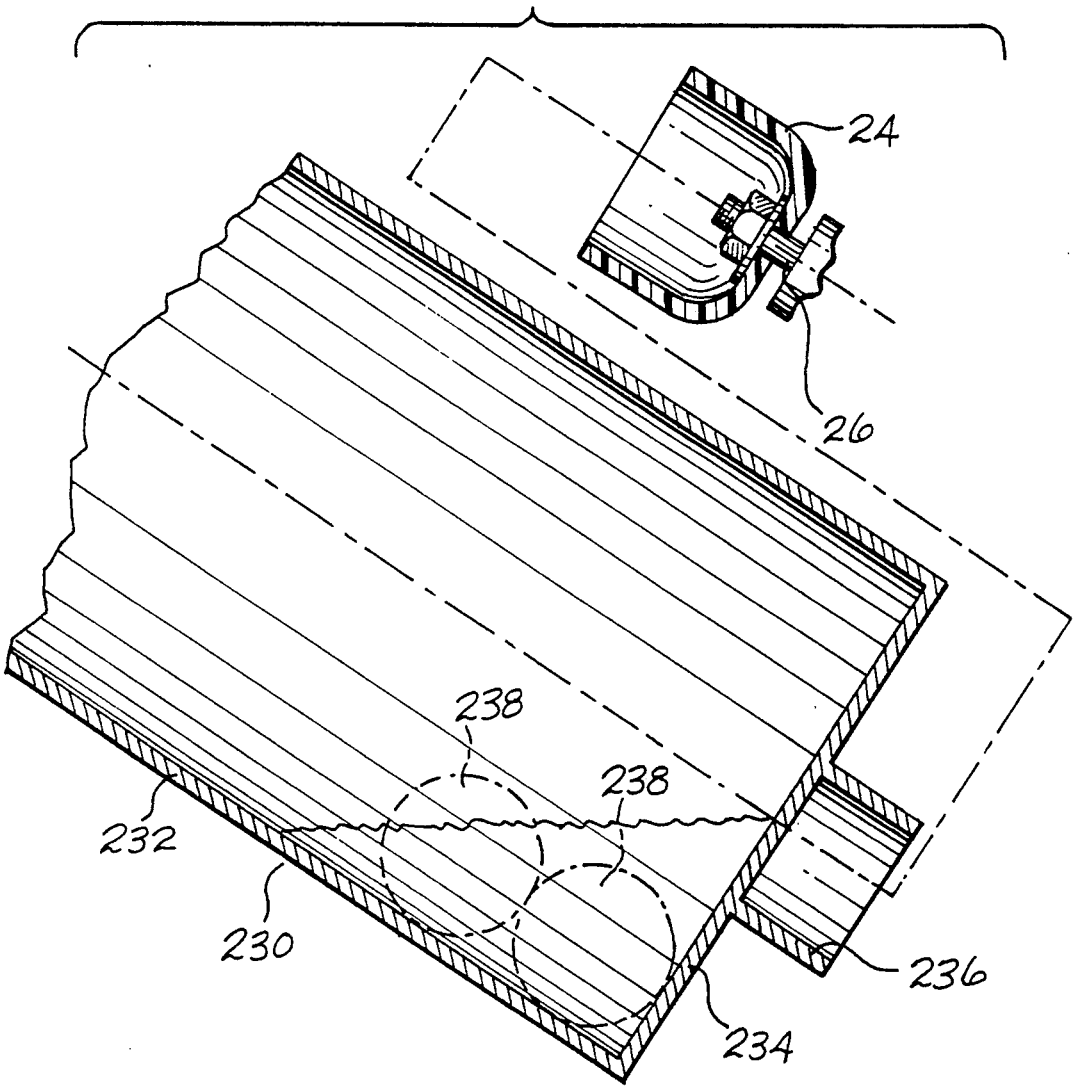
FIG. 16 is a fragmentary exploded axial sectional view of the hub drive and a mill vessel, which may be substituted for the separator pan.

FIG. 16 illustrates another feature of the invention. In the embodiment shown by FIGS. 1–13, the pans 10 are removably secured to the center drive element 24. The pan 10' can be removed and a mill vessel 230 may be substituted in its place. Vessel 230 may have a cylindrical sidewall 232 and a flat bottom 234. A tubular hub shaft 236 may project from the end wall 234 and be sized to fit within drive member 24. Tubular shaft 236 may be secured to drive member 24 by means of a set screw. Of course, the construction of the connector between vessel 230 and the drive shaft may be done in a large number of ways. Vessel 230 and tubular shaft 236 may be constructed from steel or some other suitable structural material. Mill balls 238, or mill elements of a different shape, are placed in the vessel 230. The gold ore is introduced into the vessel and the drive motor is operated to rotate the vessel 230. During this rotation the mill elements 238 act on the ore to crush and mechanically separate the gold particles from the ore. Following use of the mill vessel 230 and the mill elements 238, to cause a mechanical separation of the gold particles from the ore, the mill vessel 230 is removed and the separator pan 10 is installed in its place. Then, the mixture in vessel 230, minus the elements 238, is introduced into the pan in the manner described above, to cause a separation of the gold particles from the ore. As described above, the separation may be done dry, or may be done wet. Or, it may be done dry first followed by a wet treatment.

Figure 17:
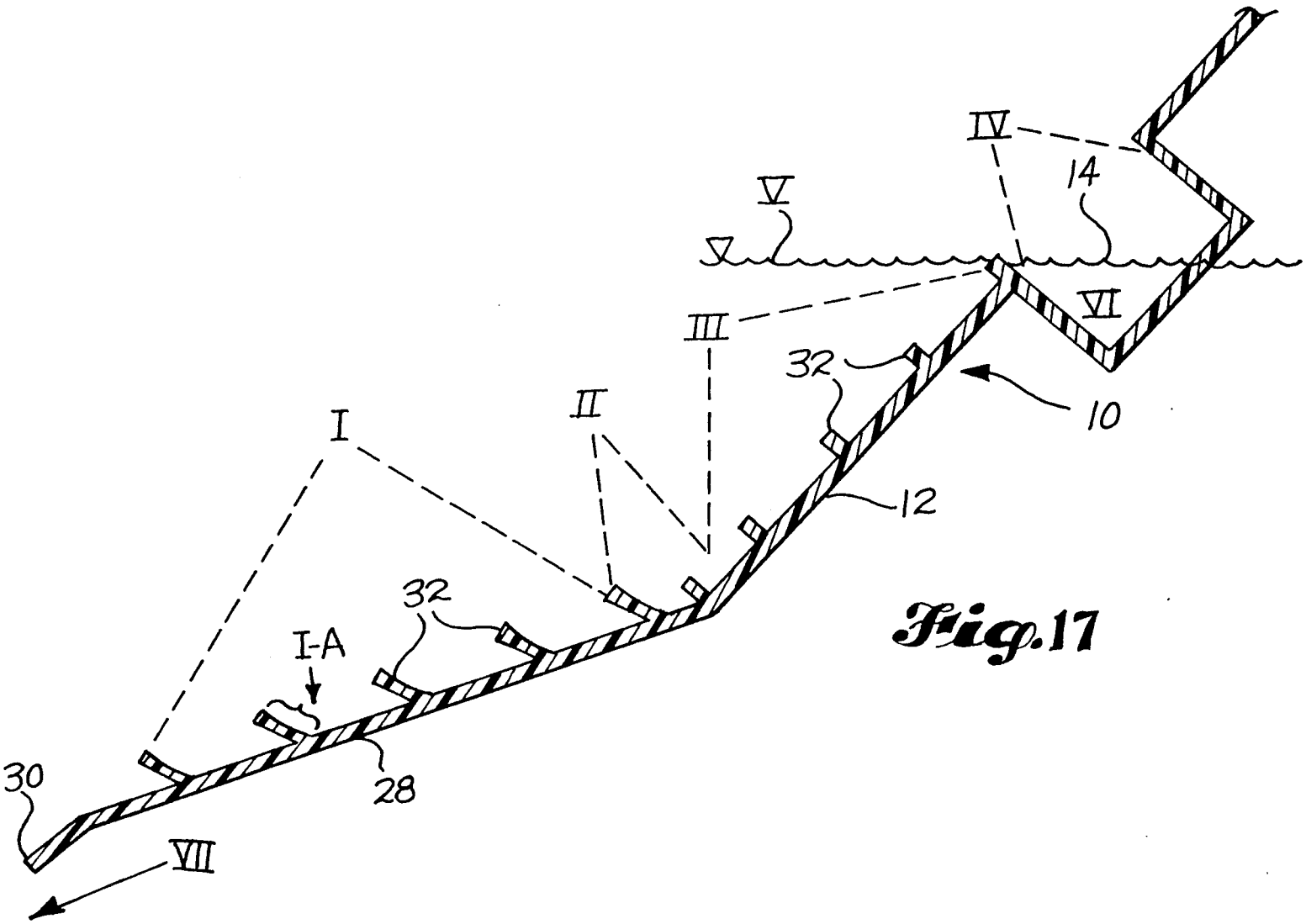
FIG. 17 is an operational diagram of the separator pan, in preferred form.

FIG. 17 is an operational diagram of the separator pan 10, in preferred form. The region I may be termed the primary physical and specific gravity classification region. The mixture of the materials to be separated is deposited into this region. The large materials and most low specific gravity materials roll or tumble from this region out of the pan 10 as the pan 10 rotates. This material moves radially downwardly and over the edge 30 into space VII. The largest specific gravity materials (e.g. gold, platinum, etc.) sink to the lowest region where the rib or riffle 32 joins the pan region 28. Rotation of the pan 10 causes this material to move towards region II and the beginning of region III.

In pan region 28, the upper surface of the rib 32 is preferably concave. In region 28, the upper surface of the rib 32 makes an obtuse angle with the inner surface of sidewall 28. The concave shape of the upper rib surface influences the heavy particles inwardly to the juncture between the rib 32 and the sidewall 28. This region defined by the upper surface of the rib 32 and the inner surface of sidewall 28 may be termed the maximum classification and fine gold retention area.

Region II may be termed the riffle transition and large nugget recovery region. Nuggets too large to spiral up the rib or riffle 32 in region III will remain in region II until visually sighted and removed by an operator. In region II, and continuing through region III, the riffle 32 becomes shorter. In region III, the concave surface is eliminated. The riffle 32 extends perpendicular out from the bottom 12.

Region III may be termed the secondary classification area. This region III classifies the materials which remain after classification in region I. The high specific gravity material (e.g. gold, platinum, etc.) will continue to travel in the valley formed by and between riffle 32 and pan bottom 12. Most of any remaining low specific gravity material will tumble downwardly into region I.

Area IV is within the hub cup 14. This may be referred to as the final classification area. A preferred water line is designated V. The materials remaining in the valley region defined by riffle 32 and pan bottom 12 will by rotation of the pan 10 be moved into the hub cup 14, and specifically into region VI. The large specific gravity materials sink into region VI as the cup 14 rotates and the material tumbles. Classification within hub cup 14 is a continuous process. Smaller specific gravity materials are pushed out of the hub cup 14 as the riffle 32 deposits additional large specific gravity material.

The example embodiments which have been described and illustrated are not to be used to limit the scope of protection. Rather, the scope of protection is to be determined by the claims which follow, interpreted in accordance with the established rules of patent claim interpretation, including use of the doctrine of equivalents.

What is claimed is:

1. A separator for separating gold particles from gold ore, comprising:

a three-legged frame including a front part having first and second legs and a top part interconnecting said first and second legs, and a rear part comprising a single third leg having an upper end connected to the top part of said front part, said front and rear parts of the frame extending downwardly from their connection, and diverging apart as they extend downwardly;

a transverse frame member extending between and interconnecting said first and second legs;

a rotatable gold pan mounted on said transverse frame member for rotation about an axis, said gold pan including a bottom, a generally frusto-conical sidewall having a small diameter inner end connected to said bottom and a large diameter outer end, a hub cup at the center of the bottom, and a spiral rib inside said pan, spiraling inwardly from the outer end of the sidewall to said hub cup, first on the sidewall of the pan and then on the bottom of the pan;

said mounting frame mounting the pan to lean backwards from vertical, into a position with said sidewall presenting a lower portion which slopes downwardly and forwardly from said bottom;

wherein said hub cup has an open forward end where the hub cup intersects the bottom, and a closed bottom;

wherein said cup slopes downwardly and rearwardly from said forward end to said closed bottom;

wherein said spiral rib includes a radially inwardly directed surface which, below the hub cup, slopes forwardly and upwardly, both in the region of the sidewall and in the region of the bottom;

a drive motor for rotating the pan, said drive motor being positioned on the frame rearwardly of the pan and above the axis;

a drive transmission interconnecting the drive motor and the pan;

wherein in use the pan is rotated by said drive motor in a direction causing particles on the spiral rib to be moved along the spiral rib to the hub cup; and wherein in use gold ore is introduced into the pan while the pan is rotating, wherein relatively large particles of the ore gravitate radially of the pan and move across the rib and out from the pan, and wherein small gold particles are held by the rib and are moved by the rib inwardly along the spiral path of the rib into the hub cup.

2. A separator according to claim 1, comprising an upper housing mounted on the front part of the frame, wherein said drive motor is located within said upper housing.

3. A separator according to claim 1, wherein the transmission comprises a first pulley attached to the drive motor, a second pulley attached to the pan, and a belt interconnecting the two pulleys.

4. A separator according to claim 1, wherein the transmission comprises a two stage first pulley attached to the drive motor, a two stage second pulley attached to the pan, and a drive belt interconnecting the two pulleys, said first pulley including a small diameter stage and a large diameter stage and said second pulley including a large diameter stage and a small diameter stage, wherein the drive belt is positionable to interconnect the small diameter stage of the first pulley with the large diameter stage of the second pulley or the large diameter stage of the first pulley with the small diameter stage of the second pulley.

5. A separator according to claim 3, wherein said transverse frame member is adjustably affixable to the first and second legs, allowing movement of the transverse frame member for purposes of providing a desired tension in the drive belt.

6. A separator according to claim 4, wherein said transverse frame member is adjustably affixable to the first and second legs, allowing movement of the transverse frame member for purposes of providing a desired tension in the drive belt.

7. A separator according to claim 1, wherein the front part of said frame is generally U-shaped and its top part is a bight interconnecting the first and second legs, said separator further including a first connector member connected to said bight, said first connector member including a body, a transverse bolt hole extending through said body and a first side part which in use is generally vertically disposed, and said separator further including a second connector member at the upper end of the third leg, said second connector member including a body having a transverse bolt receiving opening and a second side part which in use is generally vertically disposed and is against the first side part, and a bolt insertable through one of the transverse holes and threadably engageable with threads in the other transverse hole, whereby the third leg can be pivotally moved into a desired position relative to the first and second legs and then the bolt can be tightened to draw the two side parts of the two connector members together, into tight engagement, for substantially holding the third leg in position relative to the first and second legs.

8. A separator according to claim 7, wherein the first and second side parts of the connector members include interfitting elements which lock the connector members against relative rotation when the bolt is tightened to draw the interfitting elements into engagement with each other.

9. A separator according to claim 7, wherein the front part of the frame is a single tubular member bent into a substantially U-shape, and wherein said first connector member has a mounting end portion which includes a concave surface in contact with the tubular member at the bight, and a fastener which secures the mounting end portion of the first connector member to said tubular member at the bight.

10. A separator according to claim 7, wherein the third leg of the frame is a tubular member and said second connector member includes a mounting end portion which extends into said tubular member at the upper end of the third leg.

11. A separator according to claim 9, wherein the third leg of the frame is a tubular member and said second connector includes a mounting end portion which extends into said tubular member at the upper end of the third leg.

12. A separator for separating gold particles from gold ore, comprising:

a pan mounting frame;

a rotatable gold pan mounted on said frame for rotation about an axis, said gold pan including a bottom, a generally frusto-conical sidewall having a small diameter inner end connected to said bottom and a large diameter outer end, a hub cup at the center of the bottom, and a spiral rim inside said pan, spiraling inwardly from the outer end of the sidewall to said hub cup, first on the sidewall of the pan and then on the bottom of the pan;

said pan mounting frame mounting the pan to lean backwards from vertical, into a position with said sidewall presenting a lower portion which slopes downwardly and forwardly from said bottom;

wherein said hub cup has an open forward end where the cup intersects the bottom, and a closed bottom;

wherein said cup slopes downwardly and rearwardly from said forward end to said closed bottom;

wherein said spiral rib includes a radially inwardly directed surface which, below the hub cup, slopes forwardly and upwardly, both in the region of the sidewall and in the region of the bottom;

a drive motor on said frame;

a two speed drive transmission interconnecting the drive motor and the pan;

wherein in use the pan is rotated by said drive motor and transmission at a selected speed and in a direction causing particles on the spiral rib to be moved along the spiral rib to the hub cup; and wherein in use gold ore is introduced into the pan while the pan is rotating, wherein relatively large particles of the ore gravitate radially of the pan, and move across the rib and out from the pan, and wherein small gold particles are held by the rib and are moved by the rib inwardly along the spiral path of the rib into the hub cup.

13. A separator according to claim 12, wherein the drive motor is positioned on the frame rearwardly of the pan and above the axis, and wherein the transmission comprises a first pulley attached to the drive motor, a second pulley attached to the pan, and a belt interconnecting the two pulleys.

14. A separator according to claim 13, wherein the first pulley is a two stage pulley and includes a small diameter stage and a large diameter stage, wherein the second pulley is a two stage pulley and includes a large diameter stage and a small diameter stage, and wherein the drive belt is positionable to interconnect the small diameter stage of the first pulley with the large diameter stage of the second pulley or the large diameter stage of the first pulley with the small diameter stage of the second pulley.

15. A separator according to claim 12, wherein the drive motor and pan are positioned on the mounting frame to each counterbalance the other.

16. Apparatus for separating gold particles from gold ore, comprising:

a frame including a front part having first and second legs and a top part interconnecting said first and second legs, and a rear part comprising at least one leg, said rear part having an upper end connected to the top part of said front part, said front and rear parts of the frame extending downwardly from their connection, and diverging apart as they extend downwardly;

a transverse frame member extending between and interconnecting said first and second legs, said frame member supporting a rotatable drive element;

a rotatable vessel mountable on said drive element, for rotation about an axis, said vessel including a bottom, a sidewall and a mounting shaft at the center of the bottom, said mounting shaft being connected to the drive element;

a drive motor for rotating the vessel;

a drive transmission interconnecting the drive motor and the drive element; and wherein in use gold ore is introduced into the vessel and the vessel is rotated.

17. Apparatus for separating gold particles from gold ore, comprising:

a frame including a front part having first and second legs and a top part interconnecting said first and second legs, and a rear part comprising at least one leg, said rear part having an upper end connected to the top part of said front part, said front and rear parts of the frame extending downwardly from their connection, and diverging apart as they extend downwardly;

a transverse frame member extending between and interconnecting said first and second legs, said frame member supporting a rotatable drive element;

a rotatable vessel mountable on said drive element, for rotation about an axis, said vessel including a bottom, a sidewall and a mounting shaft at the center of the bottom, said mounting shaft being connected to the drive element;

a drive motor for rotating the vessel;

a drive transmission interconnecting the drive motor and the drive element;

wherein in use gold ore is introduced into the vessel and the vessel is rotated;

wherein the vessel is a gold pan, said sidewall is a generally frusto-conical sidewall having a small diameter inner end connected to said bottom and an open, large diameter outer end, said gold pan including a hub cup at the center of the bottom and a spiral rib inside said pan, spiraling inwardly from the outer end of the sidewall to said hub cup, first on the sidewall of the pan and then on the bottom of the pan;

said mounting frame mounting the pan to lean rearwardly form vertical, into a position with said sidewall presenting a lower portion which slopes downwardly and forwardly from said bottom;

wherein said hub cup has an open forward end where the hub cup intersects the bottom, a closed rear end, and wherein said cup slopes downwardly and rearwardly from said forward end to said rear end;

wherein said spiral rib includes a radially inwardly directed surface which, below the hub cup, slopes forwardly and upwardly, both in the region of the sidewall and in the region of the bottom;

wherein in use the pan is rotated by said drive motor in a direction causing particles on the spiral rib to be moved along the spiral rib to the hub cup; and wherein in use gold ore is introduced into the pan while the pan is rotating, wherein relatively large particles of the ore gravitate radially of the pan and move across the rib and out from the pan, and wherein small gold particles are held by the rib and are moved by the rib inwardly along the spiral path of the rib into the hub cup.

18. Apparatus for separating gold particles from gold ore, comprising:

a frame including a front part having first and second legs and a top part interconnecting said first and second legs, and a rear part comprising at least one leg, said rear part having an upper end connected to the top part of said front part, said front and rear parts of the frame extending downwardly from their connection, and diverging apart as they extend downwardly;

a transverse frame member extending between and interconnecting said first and second legs, said frame member supporting a rotatable drive element;

a rotatable vessel mountable on said drive element, for rotation about an axis, said vessel including a bottom, a sidewall and a mounting shaft at the center of the bottom, said mounting shaft being connected to the drive element;

a drive motor for rotating the vessel;

a drive transmission interconnecting the drive motor and the drive element;

wherein in use gold ore is introduced into the vessel and the vessel is rotated;

wherein the vessel is a mill vessel and it includes mill elements, and wherein in use the vessel is rotated and during rotation the mill elements tumble and contact the ore and mechanically dislodge gold particles from the ore.

19. A method of separating gold particles from gold ore, comprising:

providing a rotatable gold pan which includes a bottom, a generally frusto-conical sidewall, a hub cup at the center of the bottom, and a spiral rib inside said pan which spirals inwardly from the outer end of the sidewall to said hub cup, first on the sidewall of the pan and then on the bottom of the pan;

providing a mounting frame for the pan;

mounting the pan on the mounting frame for rotation about an axis which extends axially of the hub cup;

positioning the pan on the frame so that the pan leans rearwardly and a lower portion of the pan sidewall slopes downwardly and forwardly from the bottom of the pan, and the spiral rib slopes forwardly and upwardly from the inner surface of the pan;

providing a drive motor on said frame, connected to the gold pan to rotate the gold pan in a direction causing particles on the spiral rib to move inwardly along the spiral rib towards the hub cup; and introducing gold ore into the lower portion of the pan while rotating the pan, to cause relatively large particles to gravitate radially of the pan and move across the rib and out from the pan, and cause small particles to fall on the rib and be held by the rib and be moved by the rib inwardly along the spiral path of the rib into the hub cup.

20. The method of claim 19, comprising providing a mounting frame for the pan which includes a front part having an upper part and a rear part having an upper part which is adjustably connectable to the upper part of the front part, mounting the pan on said front part, and adjustably affixing the position of the rear part of the frame to the front part of the frame for determining the attitude of the pan.

21. The method of claim 19, comprising introducing dry gold ore into the lower portion of the pan while rotating the pan at a first speed, to cause relatively large particles to gravitate radially of the pan and move across the rib and out from the pan, and cause small particles of gold and some ore to fall on the rib and be held by the rib and be moved by the rib inwardly along the spiral path of the rib into the hub cup, removing the collected gold particles and ore from the hub cup, mixing such gold particles and ore with water and introducing such mixture into the lower portion of the pan while rotating the pan at a selected second speed, to cause the ore to gravitate radially of the pan and move across the rib and out from the pan, and cause the small gold particles to fall on the rib and be held by the rib and be moved by the rib inwardly along the spiral path of the rib into the hub cup.

* * * * *